United States Patent [19]

Rees

[11] 4,415,149

[45] Nov. 15, 1983

[54] PORTABLE WORKBENCH

[75] Inventor: Spencer C. Rees, Sugar Grove, Ill.

[73] Assignee: Wen Products, Inc., Chicago, Ill.

[21] Appl. No.: 277,255

[22] Filed: Jun. 25, 1981

[51] Int. Cl.[3] ..... B43L 5/00; B25B 1/10

[52] U.S. Cl. ..... 269/88; 269/100; 269/139; 269/208; 269/246; 269/283; 269/297; 269/900; 269/901; 108/8; 108/116; 248/371; 248/454

[58] Field of Search ..... 269/901, 95, 101, 99, 269/100, 139, 219, 220, 900, 253, 208, 88, 246; 144/286 R; 108/1, 8, 9, 121, 132, 116, 146; 248/439, 440, 188.6, 166, 454, 371

[56] References Cited

U.S. PATENT DOCUMENTS

| | | | |
|---|---|---|---|
| 439,186 | 10/1890 | Reams | 108/9 |
| 836,551 | 11/1906 | Werner | 108/9 |
| 1,392,434 | 10/1921 | Miller | 269/101 |
| 1,975,857 | 10/1934 | McKenney | 108/9 |
| 2,541,508 | 2/1951 | Fleming | 144/286 |
| 2,587,177 | 2/1952 | Larson | 144/286 |
| 3,001,559 | 9/1961 | Szopo | 144/286 |
| 3,061,302 | 10/1962 | Dennis | 269/88 X |
| 3,495,552 | 2/1970 | Dietrick | 108/8 |
| 4,095,778 | 6/1978 | Wing | 269/71 |
| 4,127,260 | 11/1978 | Hickman | 269/139 |
| 4,154,435 | 5/1979 | Alessio | 269/139 |
| 4,157,174 | 6/1979 | Hickman et al. | 269/901 X |
| 4,199,135 | 4/1980 | Wohrle et al. | 269/901 X |
| 4,231,557 | 11/1980 | Blachly | 269/139 |

FOREIGN PATENT DOCUMENTS

| | | | |
|---|---|---|---|
| 493716 | 11/1928 | Fed. Rep. of Germany | 108/1 |
| 2651301 | 10/1976 | Fed. Rep. of Germany | 108/116 |

*Primary Examiner*—Frederick R. Schmidt
*Assistant Examiner*—Steven P. Schad
*Attorney, Agent, or Firm*—Hill, Van Santen, Steadman & Simpson

[57] ABSTRACT

A portable workbench including a pair of front legs and a pair of rear legs, with a support extending between the legs. A pair of beams extends laterally across the support and provides a work surface. The pair of beams and the support are adjustable to permit the beams to be positioned at a plurality of predetermined spacings relative to each other. Each of the beams has a plurality of spaced vertical axis apertures extending therethrough. A vise member having a mounting shaft extending therefrom which is proportioned to be received through one of the vertical apertures is also provided, the vise including a stationary jaw and a movable jaw together with a screw which extends between the stationary and the movable jaws for moving the movable jaw toward and away from the stationary jaw.

8 Claims, 12 Drawing Figures

Fig. 1
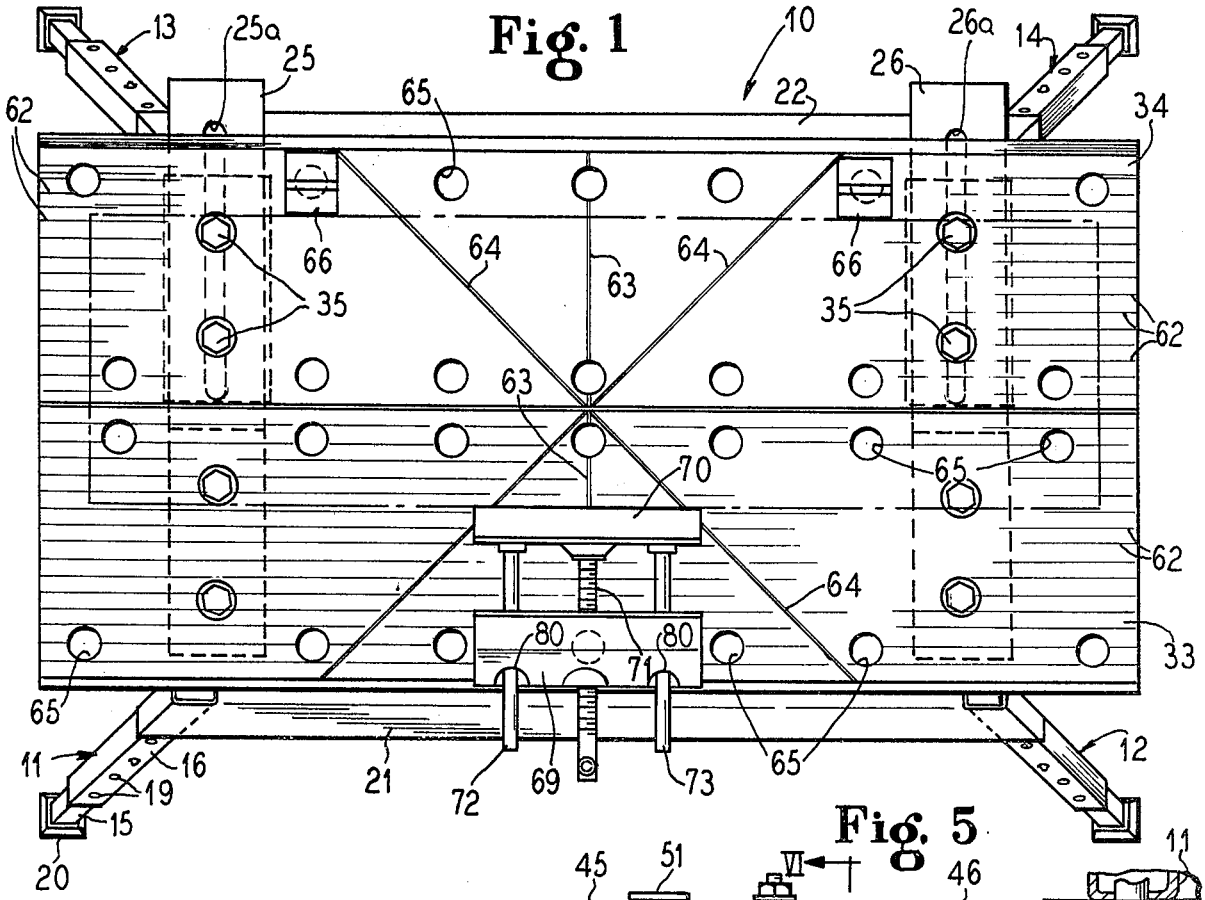
Fig. 5
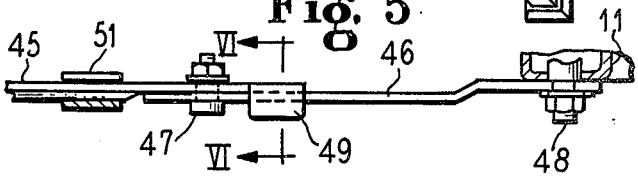
Fig. 7
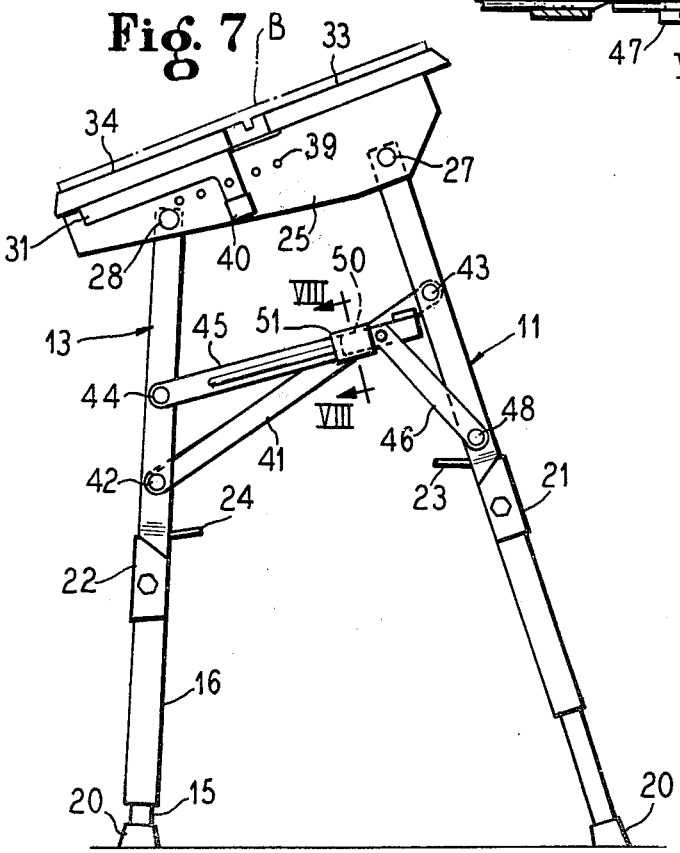
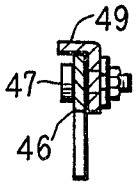
Fig. 6
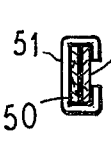
Fig. 8

Fig. 2
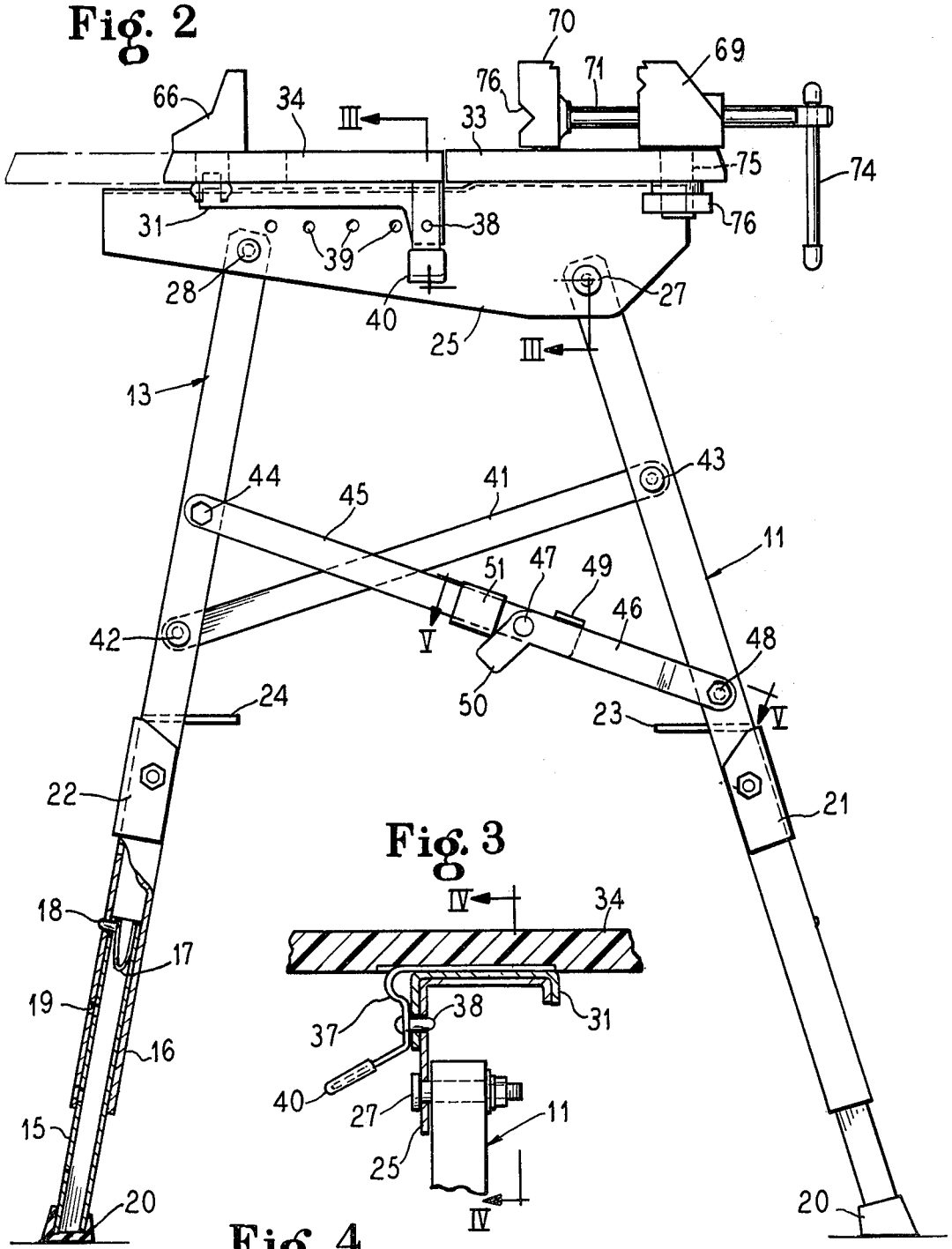
Fig. 3
Fig. 4
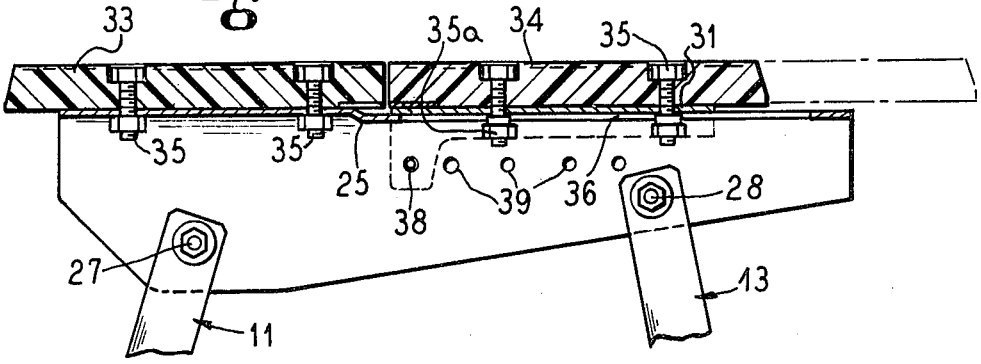

PORTABLE WORKBENCH

BACKGROUND OF THE INVENTION

1. Field of the Invention

This invention is in the field of portable workbenches which include a folding frame capable of being folded into a relatively small package for easy transport, and also foldable into a work position where the working surface is horizontal, and an easel position in which the working surface is downwardly inclined.

2. Description of the Prior Art

Portable workbenches which provide some type of vise structure for handling relatively large objects have taken many different forms in the prior art. Fleming U.S. Pat. No. 2,541,508 describes a clamping sawhorse and workbench. Foldable workbenches of various designs are shown in Larson U.S. Pat. No. 2,587,177; Szopo U.S. Pat. No. 3,001,559; Alessio U.S. Pat. No. 4,154,435, and Blachly U.S. Pat. No. 4,231,557. A combination worktable and vise of somewhat different design is shown in Wing U.S. Pat. No. 4,095,778 and Hickman U.S. Pat. No. 4,127,260.

Currently, there are a large number of portable workbenches on the market which use double crank assemblies so that each of the upper beams is independently positionable, within limits, to accommodate irregularly shaped workpieces. Such structures are shown, for example, in the following U.S. Pat. Nos. 3,841,619; 4,034,684; 4,061,305; 4,061,323; 4,073,484; 4,076,229; 4,140,309; 4,157,174; 4,159,821; 4,169,606; 4,216,949; 4,223,881.

While these workbenches have been widely advertised and sold their usefulness is somewhat limited and they are not as flexible as might be desired. In addition, the portable workbenches presently available commercially are relatively expensive.

SUMMARY OF THE INVENTION

The present invention provides an improved portable workbench which includes a pair of front legs and a pair or rear legs, with support means extending between the legs. A pair of beams extend laterally across the support means and provide a work surface therefor, the beam being positionable relative to each other to accommodate different sizes of workpieces in a gripping stance.

One of the features of the present invention resides in an improved type of vise which is positionable in a wide variety of locations along the top of the work surface by virtue of a mounting shaft extending from the vise, and positionable within a wide variety of apertures located on both of the laterally extending beams. The vise employed in the preferred embodiment of the present invention is a double-acting vise so that objects of various shapes can be accommodated between a movable jaw and a stationary jaw on the vise, the stationary and movable jaws having confronting substantially planar faces arranged to clamp a workpiece, the movable jaw also having a face opposite from the planar face which has a groove therein for receiving a circular workpiece thereagainst. This second face of the jaw cooperates with adjustably positionable chocks which are received in tight frictional engagement within the aforementioned vertical axis apertures on the two beams.

Another feature of the present invention resides in the ability to position the beams and lock the same in other than horizontal relationship. Specifically, the beams according to the present invention can be locked in an easel type position wherein the work surface provided by the beams slopes downwardly at an angle to the legs, thereby providing a conveniently accessible surface for drafting, painting, and the like. Locking means are provided to lock the support means in this easel position.

Still other features of the present invention make the portable workbench suitable for use as a machinist, woodworking, or hobby vise. The legs of the workbench are individually adjustable with respect to height. The top rails forming the work surface are adjustable to provide spacings which may correspond to the dimensions of standard sizes of lumber. The workbench may also include a built-in tool holder for holding small hand tools. It folds to a relatively thin package for easy storage.

The working surface of the workbench has sawdust grooves which are spaced small distances apart so that the grooves can be used as rough measuring tools. Furthermore, the work surface may be provided with 45° calibrated marks to facilitate miter cuts.

The vise structure itself is designed for use not only in conjunction with the improved workbench of the present invention, but can be used as such on other workbenches. Furthermore, the design of the vise is such that it can be used in the nature of a C-clamp when turned on its side thereby further increasing the versatility of the device.

BRIEF DESCRIPTION OF THE DRAWINGS

A further description of the present invention will be made in conjunction with the attached sheets of drawings which illustrate a preferred embodiment thereof.

FIG. 1 is a plan view illustrating the workbench of the present invention with the two rails defining the work surface in their most closely spaced position;

FIG. 2 is a side elevational view of the workbench shown in FIG. 1;

FIG. 3 is a cross-sectional view taken substantially along the line III—III of FIG. 2;

FIG. 4 is a cross-sectional view taken substantially along the line IV—IV of FIG. 3;

FIG. 5 is a cross-sectional view taken substantially along the line V—V of FIG. 2;

FIG. 6 is a cross-sectional view taken substantially along the line VI—VI of FIG. 5;

FIG. 7 is a side elevational view of the workbench with the legs and support structure in the easel position;

FIG. 8 is a cross-sectional view taken substantially along the line VIII—VIII of FIG. 7 illustrating the operation of the locking sleeve;

FIG. 11 is a plan view illustrating the positioning of the vise and the chock for receiving a particularly wide surface to be worked on.

DESCRIPTION OF THE PREFERRED EMBODIMENTS

Figure 9:
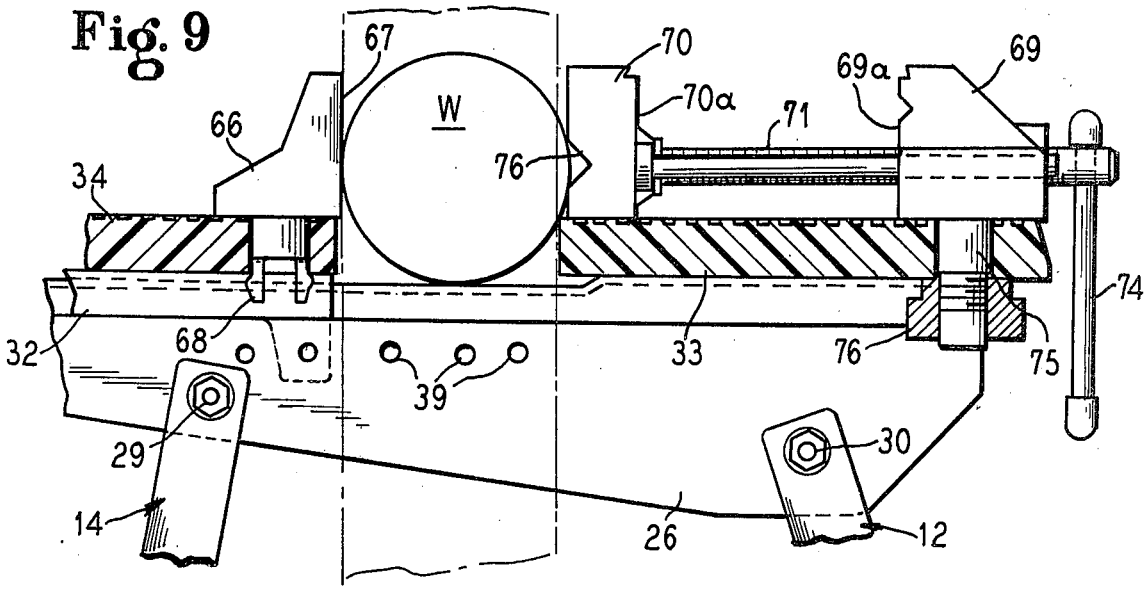
FIG. 9 is a fragmentary cross-sectional view of the workbench and vise assembly illustrating the manner in which a workpiece with a circular cross section can be held between the vise and individually positionable chock means.

In FIG. 1, reference numeral 10 indicates generally a workbench embodying the improvements of the present invention. The bench is supported on four legs, including a pair of front legs 11 and 12 and opposed rear legs 13 and 14. Each of the leg structures can be identical, so that a description of one will suffice for all. The leg structures are made adjustable by providing telescoping leg sections 15 and 16 as best illustrated in FIG. 2. A spring clip 17 is confined within the inner leg sections 15, and urges a detent 18 through an aperture in the inner leg section 15 and into one of a plurality of holes 19 formed in each of the outer leg sections 16. A resilient foot 20 is provided at the base of each of the leg structures to provide a non-slipping floor-engaging surface.

The front legs 11 and 12 are interconnected for the purposes of rigidity and stability by means of a front leg support 21, while the rear legs 13 and 14 are interconnected by means of a rear support leg 22. The front support leg 21 may have a shelf 23 extending rearwardly therefrom, and the rear support leg 22 may also be provided with a shelf 24 similarly disposed. The shelves 23 and 24, when suitably apertured, provide convenient storage places for holding small hand tools such as screw drivers, chisels, pliers, and the like.

At the top of the frame structure provided by the four legs 11 through 14, inclusive, there is provided a support structure for receiving the work surface, such support structure including a pair of main slotted support arms 25 and 26, support arm 25 interconnecting legs 11 and 13 and support arm 26 interconnecting legs 12 and 14. Leg 11 is connected to the support arm 25 by means of a pivot pin 27 (FIG. 3) so that leg 11 can be moved in an arc with respect to the support structure. Similarly, leg 13 is pivotally connected to the support arm 25 by means of a pivot pin 28 while legs 12 and 14 are connected to the support arm 26 by means of pivot pins 30 and 29, respectively. As best seen in FIG. 3, the support arm 25 (and the support arm 26) are generally U-shaped in cross section and are received within a pair of slides 31 and 32, respectively.

The main support arms 25, 26, and the slides 31, 32 serve as the support structure for a pair of laterally extending beams consisting of a stationary beam 33 and a movable beam 34. While these beams may be composed of wood, it is preferred that they be made of a stiff, lightweight structural material such as structural foam.

As best illustrated in FIG. 4, the movable beam 34 is secured to the top slide 31 by means of countersunk bolts 35 and shoulder nuts 35*a*. The shoulders of the nuts 35*a* are received in slots 25*a* and 26*a* to hold the movable beam against disengagement with the support while permitting displacement relative to stationary beam 33.

The top slides 31 and 32 each carry detent mechanisms for adjustably positioning the movable beam 34 with respect to the stationary beam 33. As best illustrated in FIG. 3, such detent mechanism may include a spring arm 37 positioned in a groove along the bottom of beam 34 and carrying a detent 38 which is arranged to be received through apertures in the slides 31 and 32 when such apertures register with apertures 39 formed in the main support arms 25 and 26. A finger gripping portion 40 is provided to facilitate movement of the detent pin 38 into and out of locked position within the registering apertures.

The spacing between the apertures 39 can be such that at the various locations, a gap will be provided to facilitate receiving lumber of standard size. For example, in the substantially closed position illustrated in FIG. 1, the gap between the stationary beam 33 and the movable beam 34 can be on the order of 1/16" so that it can accommodate thin workpieces such as sheet metal. At the first opening beyond the substantially closed position, the gap can be made, for example, to measure about 0.87 inches and in the third position (illustrated in FIG. 7) the gap can be about 1.920 inches. The fourth and fifth positions are selected so that the gap sizes are 2.850 and 3.781 inches, respectively.

The workbench is made partially or completely collapsible by providing pivotal linkages between the front and back legs. As illustrated in FIG. 2, the front legs 11 and 12 are connected to rear legs 13 and 14 by means of struts 41 anchored at one end to pivot pins 42 on the rear legs and at their opposite ends to pivot pins 43 on the legs 11 and 12. Pivot pins 44 anchor one end of other struts 45 which are pivotally connected to struts 46 at pivot pins 47, the opposite ends of the struts 46 being pivotally secured to the legs 11 and 12 by means of pivot pins 48. Struts 48 each have inwardly formed tongues 49 which engage the struts 46 so that the struts 46 and the struts 45 form a straight line in the extended position of the worktable illustrated in FIG. 2. Angular extensions 50 are also formed on the struts 46 to cooperate with slidable locking sleeves 51 in a manner to be described later.

Returning to FIG. 1, the stationary beam 33 as well as the movable beam 34 can be provided with grooves 62 which extend laterally across the respective beams, and serve as sawdust collecting grooves. Conveniently, the spacing of the grooves can be, for example, ¼" or ½" to provide the user with a rough measuring scale on the working surface of the worktable.

The face of the table can also be provided with transversely extending grooves 63 and grooves 64 which extend at a 45° angle to the horizontal and vertical, thereby providing convenient lines for making miter cuts.

For convenience of manufacture, the two beams 33 and 34 can be made identical. Each is provided with a pattern of vertical axis apertures 65 extending therethrough. Such apertures may serve for positioning the vise structure to be described later and they may also serve to hold movable chock members 66, one of which is illustrated best in FIG. 9. As seen in that Figure, the chock member 66 has a planar confronting surface 67 and a pair of flexible fingers 68 which are received in tight frictional engagement within one of the apertures 65.

Turning now to a description of the vise structure shown best in FIGS. 1, 2 and 9, there is provided a stationary jaw 69 cooperating with a movable jaw 70. Screw means such as a jackscrew 71 extend between the stationary jaw 69 and the movable jaw 70 for moving the movable jaw 70 toward and away from the stationary jaw 69. The confronting faces 69*a* and 70*a* of the two jaw members may be substantially planar although they may be ribbed, if desired, to provide a better gripping surface for a workpiece held therebetween. A pair of guide posts 72 and 73 are positioned on opposite sides of the jackscrew 71 and extend through the stationary jaw member 69 to permit guided relative movement between the stationary and movable jaw members upon rotation of the jackscrew 71. A handle 74 slidably received within an aperture formed in the end of the jackscrew 71 is provided to move the movable jaw 70 with respect to the stationary jaw 69.

The vise structure has a mounting stud 75 on the stationary jaw 69 which has a threaded end portion received through one of the vertical axis apertures 65, as best illustrated in FIG. 9. A threaded locking ring 76 is provided to secure the stationary jaw 69 to the stationary beam 33.

The movable jaw member 70 of the vise has a groove 76 formed in the face opposite to the face 70*a*. This groove facilitates engaging a circular cross-sectional workpiece such as the workpiece W shown in FIG. 9, the workpiece being confined between the groove 76 on the movable jaw member 70, and the planar surface 67 of the chock member 66.

The versatility of the vise-worktable combination of the present invention is illustrated in several of the Figures. For example, in FIG. 7, the locking sleeves 51 are shown confining the angular extensions 50 to the struts 45. The rear legs 13 and 14 are lowered accordingly, and the front legs 11 and 12 are raised to provide an easel type structure in which the beams 33 and 34 provide a working surface which extends angularly downwardly. To provide a smooth working surface in the easel position, a board B having a furring strip depending therefrom may be positioned over the beams 33 and 34 and the strip clamped in the space between the two beams.

Figure 10:
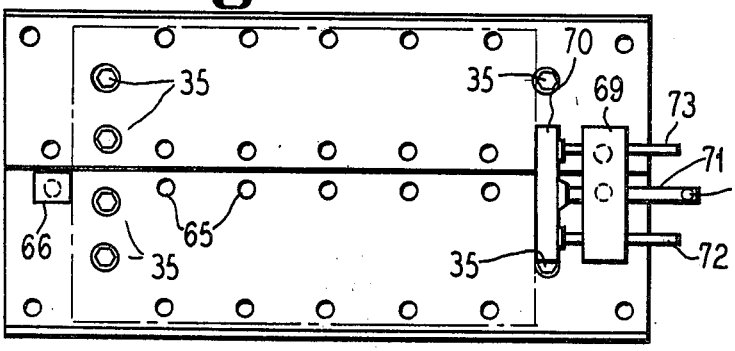
FIG. 10 is a plan view illustrating the manner in which the vise and chock means cooperate to hold a wide piece of material being worked upon.

FIG. 10 illustrated one manner of positioning the double-acting vise to accommodate a relatively wide workpiece. As shown, the workpiece is confined between the movable jaw 70 and a chock 66, with the major axis of the stationary jaw 69 being perpendicular to the major axis of the working surface.

Figure 11:
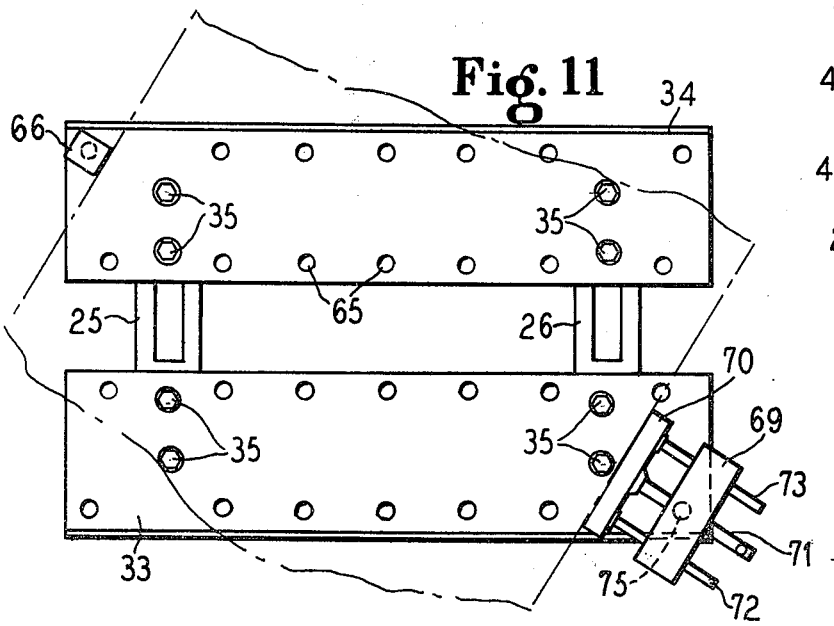

FIG. 11 illustrates the manner in which a workpiece of maximum width can be accommodated on the worktable of the present invention. In this instance, the mounting stud 75 of the double-acting vise is inserted into an aperture 65 which is at an extreme edge portion. The workpiece is then confined between the movable jaw 70 and a chock 66 positioned at the opposite extreme of the work surface.

Figure 12:
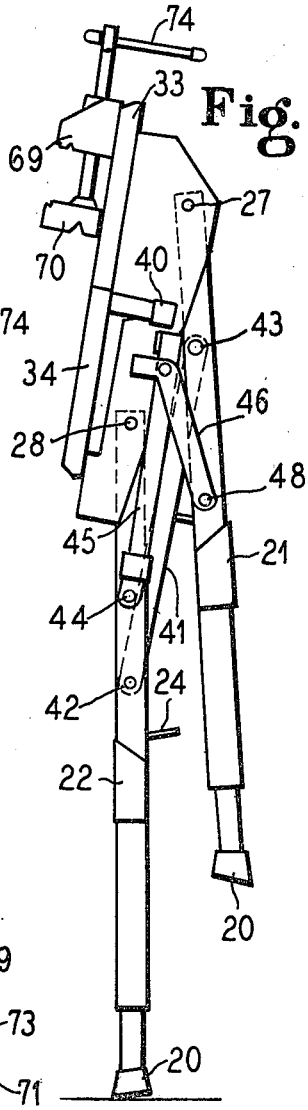
FIG. 12 is a side elevational view illustrating the workbench and vise assembly in its completely folded condition.

FIG. 12 illustrates the collapsed condition of the workbench. As illustrated, the struts 45, 46 have been pivoted around their respective pivot pins 44 and 48 and the struts 41 have been pivoted around their respective pivot pins 42 and 43 to raise the front legs 11 and 12 with respect to the rear legs 13 and 14. The workbench in this condition is readily portable for movement between job sites.

The double-acting vise may also be used in a permanent installation independent of the workbench. As shown in FIG. 1, the stationary jaw 69 is recessed as indicated at 80 and vertical mounting holes (not shown) are provided within the recesses so that mounting bolts can be inserted below the guide posts 72 and 73 to secure the vise to a rigid bench or the like.

It will be understood from the foregoing that the workbench of the present invention provides a doubleacting bench suitable for use by machinists, woodworking enthusiasts, and hobbyists. The work surface can be horizontal for most woodworking operations, or can be tilted for use as a drawing table or an artist's easel, and locked in that position. The assembly includes a built-in tool holder for conveniently holding small hand tools. It folds to a very small thickness making it easy to transport and easy to store. The table and vise capacities are quite substantial, making it possible to use large and awkwardly shaped workpieces.

It should be evident that various modifications can be made to the described embodiments without departing from the scope of the present invention.

I claim as my invention:

1. A portable workbench comprising:

a plurality of spaced legs, support means extending between said legs, a pair of beams extending laterally across said support means and providing a work surface therefor, adjustment means cooperating between said pair of beams and said support means to permit said beams to be positioned at a plurality of predetermined spacings relative to each other, each of said beams having a plurality of spaced vertical axis apertures extending therethrough, struts interconnecting the two front legs with the two rear legs, linkage means interconnecting said struts and permitting tilting of said work surface downwardly into a position such that said work surface is disposed angularly downwardly, releasable lock means comprising a slidable sleeve for locking said linkage means in said position, a vise member having a mounting shaft extending therefrom, said mounting shaft being proportioned to be received through one of said vertical apertures, said vise member further including:

a stationary jaw, a movable jaw, screw means extending between said stationary jaw and said movable jaw for moving said movable jaw toward and away from said stationary jaw, said stationary jaw and said movable jaw having confronting planar faces arranged to clamp a workpiece therebetween.

2. A workbench according to claim 1 which includes:

detent means on said spaced legs permitting individual adjustment of the vertical heights of said legs.

3. A workbench according to claim 1 which includes:

a plurality of chocks arranged to fit within said apertures to cooperate with said vise member in holding a workpiece on said work surface

4. A workbench according to claim 3 in which:

said chocks are received within said apertures in tight frictional engagement.

5. A portable workbench according to claim 1 wherein:

said movable jaw also has a face opposite from said planar face having a groove therein for receiving a circular workpiece thereagainst.

6. A portable workbench according to claim 1 wherein:

said screw means comprises:

jackscrew means extending through said stationary jaw member and bottomed in said movable jaw member arranged to vary the spacing between said jaw members, a threaded mounting stud fixedly secured to said stationary jaw member substantially perpendicular to said jackscrew means, and an internally threaded locking cap arranged to be received on said threaded mounting stud for securing said vise to a supporting surface.

7. A portable workbench according to claim 6 which includes:

a guide post on either side of said jackscrew means, said guide posts extending through said stationary jaw member for permitting guided relative movement between said stationary and said movable jaw members upon rotation of said jackscrew means.

8. A portable workbench according to claim 6 in which:

said movable jaw member and said stationary jaw member have confronting planar gripping faces, and said movable jaw member having a groove on its opposite face for accommodating circular workpieces.

* * * * *